US008870177B2

(12) United States Patent
Tanaka

(10) Patent No.: US 8,870,177 B2
(45) Date of Patent: Oct. 28, 2014

(54) SHEET PROCESSING APPARATUS AND IMAGE FORMING SYSTEM

(71) Applicant: Konica Minolta, Inc., Tokyo (JP)

(72) Inventor: Yu Tanaka, Yokohama (JP)

(73) Assignee: Konica Minolta, Inc. (JP)

( * ) Notice: Subject to any disclaimer, the term of this patent is extended or adjusted under 35 U.S.C. 154(b) by 0 days.

(21) Appl. No.: 13/917,168

(22) Filed: Jun. 13, 2013

(65) Prior Publication Data

US 2013/0334758 A1 Dec. 19, 2013

(30) Foreign Application Priority Data

Jun. 14, 2012 (JP) ..... 2012-134518

(51) Int. Cl.

| | |
|---|---|
| ***B65H 37/04*** | (2006.01) |
| ***B42B 4/00*** | (2006.01) |
| ***B41L 43/12*** | (2006.01) |
| ***G03G 15/00*** | (2006.01) |
| ***B42C 1/12*** | (2006.01) |
| ***B65H 9/14*** | (2006.01) |

(52) U.S. Cl.

CPC ..... *B41L 43/12* (2013.01); *G03G 2215/00827* (2013.01); *B42B 4/00* (2013.01); *G03G 2215/00421* (2013.01); *G03G 15/6541* (2013.01); *G03G 2215/00426* (2013.01); *B42C 1/12* (2013.01); *B65H 9/14* (2013.01); *G03G 2215/00704* (2013.01); *G03G 15/00* (2013.01)

USPC ..... 270/58.11; 270/58.12; 270/58.17; 399/410

(58) Field of Classification Search

USPC ..... 270/58.08, 58.11, 58.12, 58.13, 58.14, 270/58.16, 58.17; 399/410

See application file for complete search history.

(56) References Cited

U.S. PATENT DOCUMENTS

| | | | | |
|---|---|---|---|---|
| 6,142,469 | A * | 11/2000 | Nanba et al. | 271/288 |
| 6,375,181 | B1 * | 4/2002 | Kawano et al. | 270/58.12 |
| 6,601,846 | B2 * | 8/2003 | Saito et al. | 271/226 |
| 7,014,183 | B2 * | 3/2006 | Tamura et al. | 270/58.09 |
| 7,571,904 | B2 * | 8/2009 | Bober | 270/58.12 |
| 7,992,856 | B2 * | 8/2011 | Saito | 270/58.11 |

(Continued)

FOREIGN PATENT DOCUMENTS

| | | | |
|---|---|---|---|
| JP | 2001226025 | A | 8/2001 |
| JP | 2008-7207 | A | 1/2008 |
| JP | 2011105440 | A | 6/2011 |
| JP | 2002-321861 | A | 11/2012 |

OTHER PUBLICATIONS

Office Action for the Japanese patent application No. 2012-134518, dated Jul. 15, 2014. English translation attached.

*Primary Examiner* — Patrick Mackey

(74) *Attorney, Agent, or Firm* — Cantor Colburn LLP

(57) ABSTRACT

A sheet processing apparatus, including an ejection section; a sheet stacking section; an abutting unit; a driving section; a control section; and a rotating member which has a rotating shaft in parallel with a width direction of the sheet bundle and is held so as to rotate from above the base end portion of the sheet stacking section through a gap of a predetermined width in the abutting unit. The control section starts rotation of the rotating member after lowering of the sheet stacking section is stopped, and when the rotation is started, the rotating member operates so as to abut a rear portion of a surface of the sheet bundle stacked on the sheet stacking section and pass through the gap in the abutting unit.

6 Claims, 10 Drawing Sheets

(56) References Cited

U.S. PATENT DOCUMENTS 8,136,807 B2 * 3/2012 Uchiyama et al. ..... 270/58.27
8,376,355 B2 * 2/2013 Sugitani et al. ..... 271/176
8,714,547 B2 * 5/2014 Uchiyama et al. ..... 271/224
2007/0108698 A1 * 5/2007 Tamura et al. ..... 271/220
2011/0115153 A1 5/2011 Uchiyama
2013/0207333 A1 * 8/2013 Brundige et al. ..... 270/58.08

* cited by examiner

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

Conventionally, there have been known image forming systems in which sheet processing apparatuses for performing processing such as stapling are connected to image forming apparatuses such as MFPs (Multi Function Peripherals), copiers and printers.

Stapling is processing of accumulating a predetermined number of sheets of paper on which images are formed, and striking staples into the bundle of accumulated sheets to bind the sheet bundle to be a booklet. The stapled sheet bundle is ejected, by an ejection mechanism, to an ejection tray which is provided so as to protrude outside the sheet processing apparatus.

Here, operations of the ejection tray will be described with reference to FIG. 10A.

The ejection tray 201, as shown in FIG. 10A, includes a stacking surface 201*a* which is tilted upward from the base end portion to the distal end portion, and an abutting unit 202 to abut the rear end of the sheet bundle SS is provided near the base end portion of the stacking surface 201*a*. The ejected sheet bundle SS slides down the stacking surface 201*a* of the ejection tray 201 to abut the abutting unit 202 at the rear end, and thus is aligned to the sheet conveyance direction.

Further, when the sheet bundle SS is stacked on the stacking surface 201*a*, the ejection tray 201 is lowered for a predetermined distance and thus the fall distance of ejected sheet bundles SS is kept constant.

However, in a case of stacking sheet bundles SS on the ejection tray 201 as described above, as shown in FIG. 10B, there can be a phenomenon called rear end remaining that the rear end of the sheet bundle SS remains at a position of abutting the abutting unit 202 when the ejection tray 201 is lowered, and the sheet bundle may swell. This leads to a bad appearance and has caused, in some cases, stacking errors such as drop of the following sheet bundles which cannot be stacked stably.

Conventionally, there have been suggested various techniques as measures against rise and curling of the rear end portions of the sheets stacked on the ejection tray.

For example, Japanese Patent Application Laid Open Publication No. 2008-7207 describes a technique providing a scraping-off member which scrapes off the rear end of sheets immediately after the ejection and presses the rear end portions of the sheets ejected on the ejection tray to avoid the unnecessary rise.

In addition, Japanese Patent Application Laid Open Publication No. 2002-321861 describes a technique which includes a detection unit detecting that the uppermost position of the sheets stacked on the ejection tray reaches a predetermined position, and if the detection unit detects the sheet when the ejection tray stops, lowers the ejection tray until the detection unit does not detect the sheet.

However, the technique of Japanese Patent Application Laid Open Publication No. 2008-7207 does not simulate the above-mentioned rear end remaining which is caused by the lowering of the ejection tray, and is insufficient to completely solve the rear end remaining.

Also, the technique of Japanese Patent Application Laid Open Publication No. 2002-321861 merely lowers the ejection tray to a position where the sheet is not detected by the detection unit, and thus cannot solve the rear end remaining caused by the lowering of ejection tray.

SUMMARY OF THE INVENTION

The present invention has been made in consideration of the above problems in conventional techniques, and an object of the present invention is to provide a sheet processing apparatus and an image forming system which can solve the rear end remaining of sheet bundles after ejection and stably stack the following sheet bundles.

In order to achieve the above object, according to one aspect of the present invention, there is provided a sheet processing apparatus, including an ejection section which ejects a bundle of sheets on which predetermined processing is performed; a sheet stacking section on which the sheet bundle ejected by the ejection section is stacked; an abutting unit which is provided near a base end portion of the sheet stacking section and abuts a rear end of the sheet bundle; a driving section which moves the sheet stacking section upward and downward; a control section which lowers the sheet stacking section by controlling the driving section when the sheet bundle is stacked on the sheet stacking section; and a rotating member which has a rotating shaft in parallel with a width direction of the sheet bundle and is held so as to rotate from above the base end portion of the sheet stacking section through a gap of a predetermined width in the abutting unit; wherein the control section starts rotation of the rotating member after lowering of the sheet stacking section is stopped, and when the rotation is started, the rotating member operates so as to abut a rear portion of a surface of the sheet bundle stacked on the sheet stacking section and pass through the gap in the abutting unit.

Preferably, the predetermined processing is stapling.

Preferably, the sheet processing apparatus further includes a rocking member above the rotating member, the rocking member rocking in synchronization with the rotation of the rotating member, wherein the rotating member and the rocking member are a sheet nipping section which nips a rear end portion of the sheet and moves the rear end portion to an upper surface of the sheet stacking section when the sheet is to be ejected one by one by the ejection section.

Preferably, the sheet processing apparatus further includes a detection section above the sheet stacking section, the detection section detecting whether the sheet bundle stacked on the sheet stacking section exists at a predetermined position, wherein the control section starts the rotation of the rotating member when the detection section detects existence of the sheet bundle after the lowering of the sheet stacking section is stopped.

Preferably, the control section starts the rotation of the rotating member after the lowering of the sheet stacking section is stopped when the number of the sheet bundles is equal to or more than a predetermined number which is previously set.

According to the other aspect of the present invention, there is provided an image forming system, including an image forming apparatus which forms an image on a sheet of paper; and a sheet processing apparatus of claim 1 which is connected to the image forming apparatus and performs predetermined processing on the sheet on which the image is formed by the image forming apparatus.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DETAILED DESCRIPTION OF THE PREFERRED EMBODIMENT

Hereinafter, an embodiment of the present invention will be described with reference to the drawings. However, the scope of the invention is not limited to the illustrated examples.

First, a configuration of an image forming system A will be described.

Figure 1:
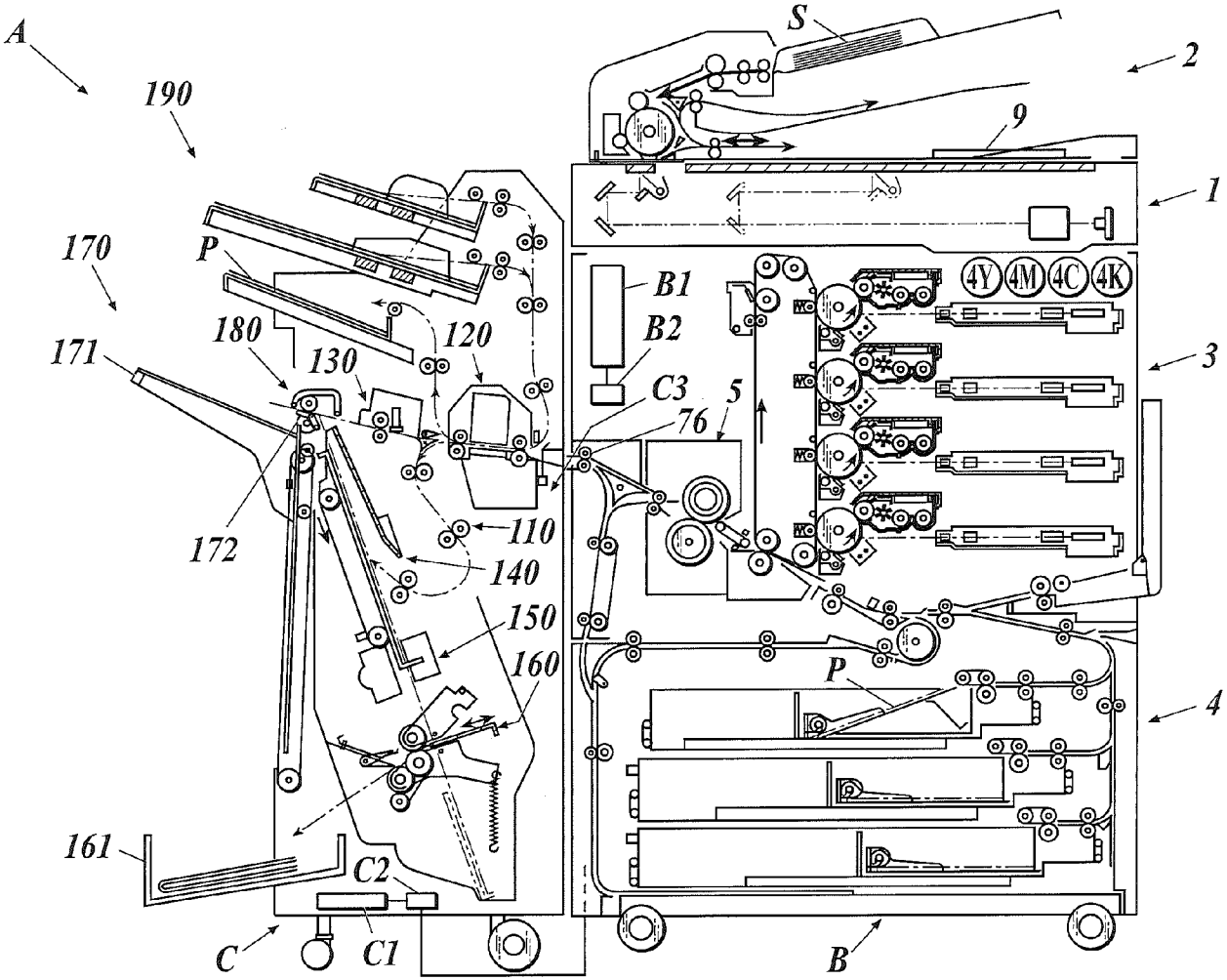
FIG. 1 is a diagram illustrating a configuration of an image forming system according to an embodiment of the present invention.

As shown in FIG. 1, the image forming system A includes an image forming apparatus B which forms an image on a sheet P and a sheet processing apparatus C which performs predetermined processing (for example, stapling) to the sheet P on which the image is formed.

The image forming apparatus B and the sheet processing apparatus C are set to be adjusted in position and height so that ejection rollers 76 of the image forming apparatus B lead to a receiving section C3 of the sheet processing apparatus C in order to receive, at the receiving section C3 of the sheet processing apparatus C, the sheet P conveyed from the image forming apparatus B.

The image forming apparatus B and the sheet processing apparatus C include a control section B1 and a control section C1, respectively, to send and receive various information through a communication unit B2 and a communication unit C2 under control of the control section B1 and the control section C1.

For example, information regarding post-processing of sheets which is set via an operation panel 9 of the image forming apparatus B is sent to the communication unit C2 of the sheet processing apparatus C via the communication unit B2 by the control of the control section B1, and the sheet processing apparatus C performs post-processing on the basis of the sent information regarding the post-processing by the control of the control section C1.

Next, a configuration of the image forming apparatus B will be described.

Figure 2:
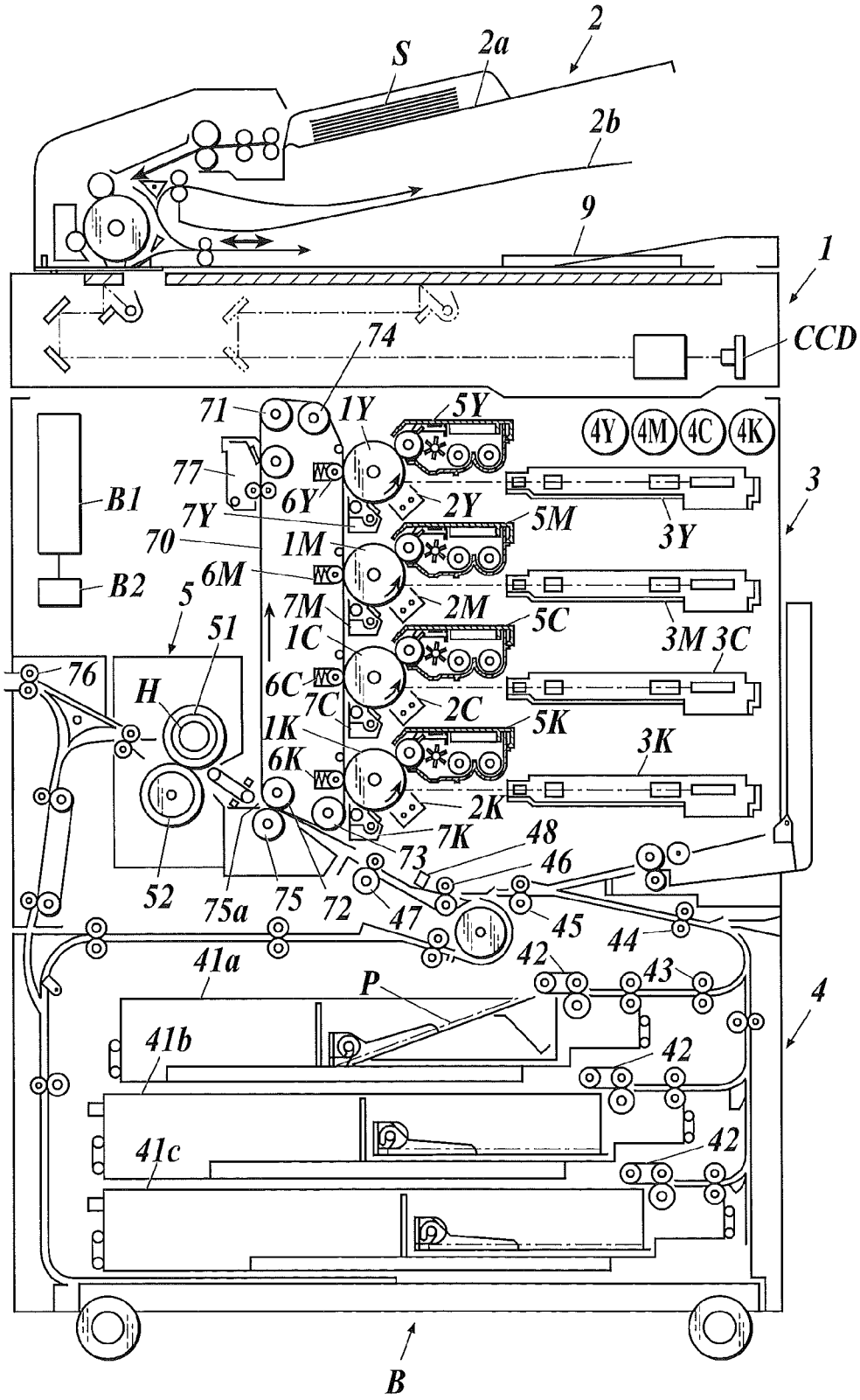
FIG. 2 is a schematic sectional view illustrating an example of an image forming apparatus.

As shown in FIG. 2, the image forming apparatus B includes a document image reading section 1 which reads a document image from a document S, an automatic document feeding device 2 which feeds the document S to the document image reading section 1, an image forming section 3 which performs image formation on the basis of the document image information and such like read by the document image reading section 1, a paper feeding section 4 which supplies sheets P to the image forming section 3, a fixing section 5 which fixes toner images on the sheet P, an operation panel 9 which has a display unit and operation switches, the control section B1 which controls the above sections, and others.

The document image reading section 1 includes, for example, a platen glass, a CCD (Charge Coupled Device) and a light source. The document image reading section 1 forms images from reflected light by the CCD and performs photoelectric conversion, the reflected light being the light reflected when scanning, from the light source, the document S supplied by the automatic document feeding device 2 or a document set at a predetermined position. Thereby, the document image reading section 1 reads the document image as R, G and B signals and outputs the read analog signals to the image processing section Ca (see FIG. 4).

The image processing section Ca performs various processing such as A/D conversion, shading correction and image compression with respect to the input analog signals and outputs digital image data for each color of Y (Yellow), M (Magenta), C (Cyan) and K (Black) to the image forming section 3.

The automatic document feeding device 2 feeds documents S stacked on the paper feeding tray 2*a* to a document reading area of the document image reading section 1 one by one. In a case of double-faced documents S, the automatic document feeding device 2 reverses the document S after reading one face of the document S and feeds the document S to the document image reading section 1 again. The document S which is completely read is ejected to the ejection tray 2*b*.

The image forming section 3 includes, for example, photoreceptor drums (hereinafter, merely referred to as photoreceptors) 1Y, 1M, 1C and 1K, charging devices 2Y, 2M, 2C and 2K, exposure devices 3Y, 3M, 3C and 3K, toner supplying devices 4Y, 4M, 4C and 4K, developing devices 5Y, 5M, 5C and 5K, an intermediate transfer member 70, primary transfer rollers 6Y, 6M, 6C and 6K, cleaning units 7Y, 7M, 7C and 7K, a secondary transfer roller 75 and a cleaning unit 77.

The photoreceptors 1Y, 1M, 1C and 1K which are respectively corresponding to the colors Y, M, C and K are uniformly charged by the corresponding charging devices 2Y, 2M, 2C and 2K.

The exposure devices 3Y, 3M, 3C and 3K which are corresponding to the respective colors form latent images on the charged photoreceptors 1Y, 1M, 1C and 1K, respectively, on the basis of the digital image data output by the image processing section Ca.

The developing devices 5Y, 5M, 5C and 5K receive toners of the respective colors from the toner supplying devices 4Y, 4M, 4C and 4K which supply new toners, and make the latent images appear, the latent images corresponding to the respective colors formed on the photoreceptors 1Y, 1M, 1C and 1K.

The developing devices 5Y, 5M, 5C and 5K and the photoreceptors 1Y, 1M, 1C and 1K are tandemly arranged in the vertical direction. The intermediate transfer member 70 is disposed on a lateral side of the photoreceptors 1Y, 1M, 1C and 1K.

The intermediate transfer member 70 is a member of endless belt which is tensioned so as to be rotatable and roll rollers 71, 72, 73 and 74, and the intermediate transfer member 70 has semiconductivity. The intermediate transfer member 70 is driven by a driving device (not shown in the drawings) which is connected to the roller 71.

The primary transfer rollers 6Y, 6M, 6C and 6K corresponding to the respective colors are operated selectively according to the types of the image by the control section B1, and depress the intermediate member 70 onto the corresponding photoreceptors 1Y, 1M, 1C and 1K.

In such way, the toner images of the respective colors formed on the photoreceptors 1Y, 1M, 1C and 1K are sequentially transferred onto the rotating intermediate transfer member 70 and form a composite color image.

The photoreceptors 1Y, 1M, 1C and 1K receive cleaning processing by the cleaning units 7Y, 7M, 7C and 7K after the toner images are transferred onto the intermediate transfer member 70. By the cleaning processing, the remaining toners on the photoreceptors 1Y, 1M, 1C and 1K are removed.

The paper feeding section 4 includes, for example, a first paper feeding cassette 41*a*, a second paper feeding cassette 41*b* and a third paper feeding cassette 41*c*. The paper feeding cassettes contain the sheets P therein.

The contained sheets P are separated one by one by the paper feeding unit 42 and conveyed through a plurality of intermediate rollers 43, 44, 45 and 46 and such like and resist rollers 47 to a secondary transfer area 75*a*.

The sheet P conveyed to the secondary transfer area 75*a* is subjected to secondary transfer by the intermediate transfer member 70 and the secondary transfer roller 75.

The secondary transfer roller 75 is biased toward the roller 72 only when the sheet P passes the secondary transfer area 75*a* to receive the secondary transfer, and presses the sheet P against the intermediate transfer member 70. Thus, the color images formed on the intermediate transfer member 70 are transferred onto the sheet P all at once.

The intermediate transfer member 70 is subjected to the cleaning processing by the cleaning unit 77 after transferring the color images onto the sheet P. By the cleaning processing, the remaining toners are removed from the intermediate transfer member 70. The sheet P on which the color image is transferred is subjected to the fixing processing by the fixing section 5.

The fixing section 5 includes a heating roller 51 incorporating a heating source H and a pressure roller 52, performs the fixing processing by the cooperation of the heating roller 51 and the pressure roller 52 nipping the sheet P therein, and conveys the sheet P.

The fixed sheet P is nipped between the paper ejection rollers 76 and supplied to the sheet processing apparatus C from the outlet.

The operation panel 9 includes, for example, a display section 9*a* (see FIG. 4) such as a liquid crystal display and an organic electro-luminescence (EL) display, and performs various display outputs according to the processing contents of the control section C1 and the control section B1. The operation panel 9 also includes an operation section 9*b* (see FIG. 4) which detects the input operation (such as contact and approach) to the display area of the display section 9*a* and outputs a detection signal indicating the position (coordinate) where the input operation is detected. The control section C1 and the control section B1 receive the input operation by a user by associating the position indicated by the detection signal with the display contents on the display section 9*a* corresponding to the position. The operation panel 9 is not limited to the operation section 9*b* and may include a switch or buttons for various kinds of input.

Next, a configuration of the sheet processing apparatus C will be described.

Figure 3:
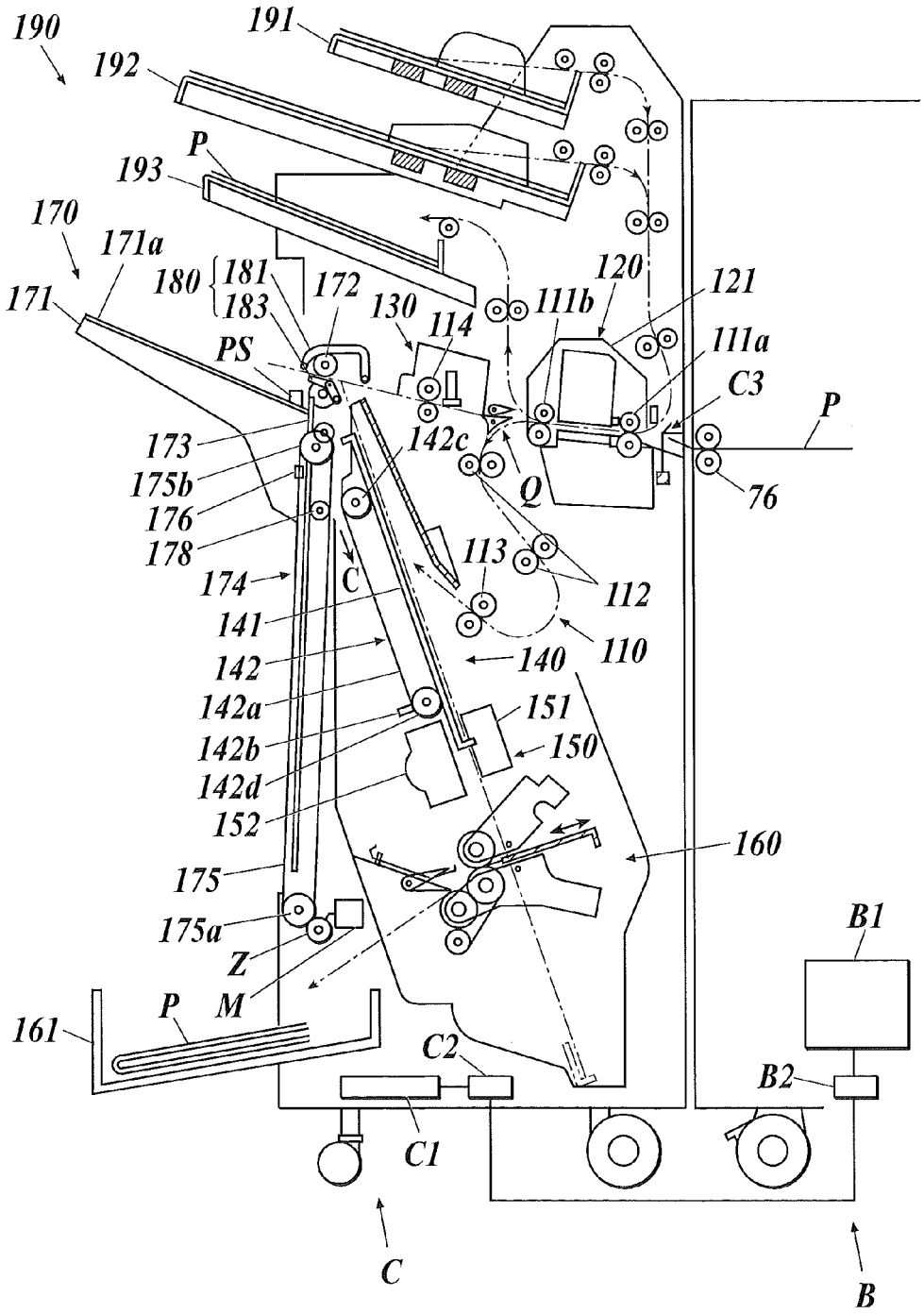
FIG. 3 is a schematic sectional view illustrating an example of a sheet processing apparatus.
Figure 4:
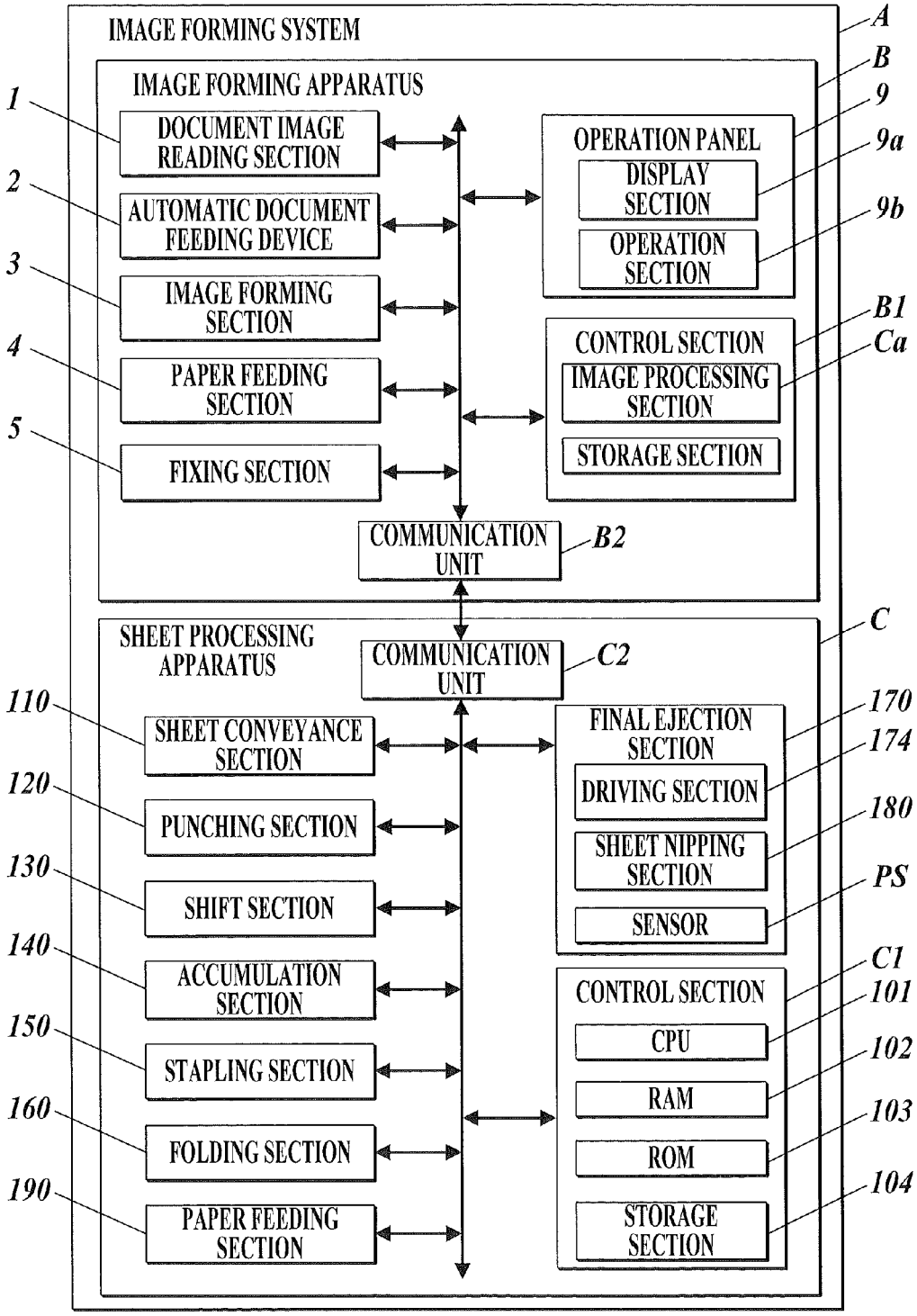
FIG. 4 is a block diagram illustrating a functional configuration of the image forming system.

As shown in FIGS. 3 and 4, the sheet processing apparatus C includes, for example, a receiving section C3, a sheet conveyance section 110, a punching section 120, a shift section 130, an accumulation section 140, a stapling section 150, a folding section 160, a final ejection section 170, a paper feeding section 190 and the control section C1.

The sheet processing apparatus C of the embodiment is configured to switch operation modes between a first mode and a second mode.

The first mode is an operation mode of ejecting the sheet P onto an elevating paper ejection tray 171 one by one.

The second mode is an operation mode of ejecting a bundle of sheets P (hereinafter, called a sheet bundle S) which is a pile of a plurality of sheets onto the elevating paper ejection tray 171.

These operation modes are automatically set by the control of the control section C1 according to the sheet processing set by the user at the start of the image forming processing.

That is, the first mode is set when the sheet P is to be ejected onto the elevating paper ejection tray 171 one by one after predetermined sheet processing is performed following the image forming processing.

The second mode is set when the sheet bundle S is to be ejected onto the elevating paper ejection tray 171 in a case where the stapling is set to be performed as a predetermined sheet processing after the image forming processing, for example.

Though the operation modes are automatically set by the control of the control section C1 as described above, when the user sets an operation mode through the operation panel 9, the operation mode according to the setting operation is set in priority.

The receiving section C3 receives, inside the sheet processing apparatus C, the sheet P on which image is formed by the image forming apparatus B and which is ejected from the outlet of the image forming apparatus B.

The sheet conveyance section 110 conveys the sheet P to the sections inside the sheet processing apparatus C.

The sheet conveyance section 110 includes a pair of rollers 111*a* which convey the sheet P supplied from the image forming apparatus B to the punching section 120, a pair of rollers 111*b* which convey the punched sheet P to a branch point Q, a pair of rollers 112 which convey the sheet P downward from the branch point Q, a pair of rollers 113 which convey the sheet P conveyed by the pair of rollers 112 to the accumulation section 140, a pair of rollers 114 which convey the sheet P from the branch point Q to the shift section 130, and others.

The punching section 120 performs punching to form punch holes on the sheet P.

The punching section 120 includes a punching unit 121 loading a plurality of punch rods, and when the sheet P is conveyed to a predetermined position, the punching section 120 forms punch holes by lowering the punch rods to the punching positions of the sheet P and lifting the punch rods again.

The shift section 130 performs shift processing of shifting the sheet P conveyed straight from the branch point Q, so as to be at the right angle to the conveyance direction.

The accumulation section 140 accumulates a predetermined number of sheets P conveyed downward from the branch point Q by the pair of rollers 112 and then conveyed by the pair of rollers 113.

The accumulation section 140 is configured by including a sheet accumulation plate 141 for accumulating the sheets P so as to be inclined, an ejection mechanism 142 which ejects the sheet bundle on the sheet accumulation plate 141, and others.

A stopper (not shown in the drawings) is provided at the lower end portion of the sheet accumulation plate 141 so that the sheet P released from the nip of the pair of rollers 113 and ejected to the space above the sheet accumulation plate 141 falls down by its own weight and abuts the stopper to stop. When a plurality of sheets P are conveyed to the accumulation section 140 in series, the plurality of sheets P are thus accumulated in layers on the surface of the sheet accumulation plate 141.

The ejection mechanism 142 is configured by including an ejection belt 142*a* which rotates and an ejection tab 142*b* which is provided so as to protrude from the outer circumferential surface of the ejection belt 142*a*.

The ejection belt 142*a* is a belt member which is tensioned between the two rollers 142*c* and 142*d* on the inner side, and disposed along the back surface of the sheet bundle S stacked on the sheet accumulation plate 141.

The two rollers 142*c* and 142*d* rotate by a motor rotating according to the control of the control section C1, and thus the ejection belt 142*a* rotates in the direction of the arrow C in FIG. 3.

The ejection tab 142*b*, according to the rotation of the ejection belt 142*a*, moves around along the disposed position of the ejection belt 142*a*. The ejection tab 142*b*, according to the rotation of the ejection belt 142*a*, abuts the lower end portion of the sheet bundle S after stapled by the stapling section 150, lifts up the sheet bundle S along the surface of the sheet accumulation plate 141 and moves the sheet bundle S from the accumulation section 140 to the final ejection section 170.

The stapling section 150 performs stapling (binding) on the sheet bundle S including a predetermined number of sheets accumulated on the sheet accumulation plate 141 by penetrating the sheet bundle S with the both ends of U-shaped needles and folding the both ends of the penetrating needles so as to face each other inside the U-shape to bind the sheet bundle S.

The stapling section 150 is provided below the sheet accumulation plate 141 of the accumulation section 140 and includes a needle striking mechanism 151 which strikes needles into the sheets P and a needle receiving mechanism 152 which folds the distal ends of the struck needles.

The stapled sheet bundle S is conveyed toward the final ejection section 170 by the ejection mechanism 142 of the accumulation section 140.

The folding section 160 folds the sheet bundle S which is stapled in the stapling section 150, in the middle portion, in a case of the folding processing being selected.

The folding section 160 is provided below the accumulation section 140 and folds the sheets P which are conveyed by the sheet accumulation plate 141 being lowered.

The folded sheet bundle S is ejected to the ejection tray 161 provided so as to protrude downward outside the sheet processing apparatus C.

The final ejection section 170 performs sheet ejection operation of ejecting the sheet P conveyed from the shift section 130 or the sheet bundle S conveyed from the accumulation section 140 onto the elevating paper ejection tray 171 which is provided so as to protrude outside the sheet processing apparatus C.

Specifically, as shown in FIGS. 3 to 6, the final ejection section 170 is configured by including the elevating paper ejection tray (sheet stacking section) 171 on which the sheets P or the sheet bundles S are stacked, pairs of ejection rollers (ejection section) 172 and 172 which eject the sheets P and the sheet bundles S to the elevating paper ejection tray 171, an abutting unit 173 which the rear end portions of the sheets P and the sheet bundles S abut, a driving section 174 which moves the elevating paper ejection tray 171 upward and downward, a sheet nipping section 180 which is rotatable above the base end portion of a stacking surface 171*a* of the elevating paper ejection tray 171, a detection sensor (detection section) PS which detects whether the sheet bundles S stacked on the elevating paper ejection tray 171 exist at a predetermined position, and others.

The stacking surface 171*a* for stacking the sheets P and the sheet bundles S ejected by the pairs of ejection rollers 172 and 172 is formed on the elevating paper ejection tray 171. The stacking surface 171*a* is inclined upward from the base end portion toward the distal end portion, and the abutting unit 173 for abutting the rear end portions of the sheets P and the sheet bundles S is provided near the base end portion of the stacking surface 171*a*.

When the image forming apparatus B starts the image forming processing, the elevating paper ejection tray 171 is moved to be at a predetermined height which is previously set by the drive of the driving section 174, before the sheet P or the sheet bundle S is ejected. The predetermined height is the height which is lower than the sheet nipping section 180 and does not disturb the operations of the sheet nipping section 180.

When the sheet P is stacked on the stacking surface 171*a*, the elevating paper ejection tray 171 is lowered according to the weight of the accumulated sheets P.

When the sheet bundle S is stacked on the stacking surface 171*a*, the elevating paper ejection tray 171 is lowered for a distance which is previously determined according to the thickness of the sheet bundle S.

Thus, the ejected sheet P or sheet bundle S is lowered for a constant distance (the distance from a nipping position of the pairs of ejection rollers 172 and 172 to the surface of the elevating paper ejection tray 171 or the uppermost surface of the sheets P or the sheet bundles S).

The detection sensor PS is provided at a position above the stacking surface 171*a* of the elevating paper ejection tray 171 and below the sheet nipping section 180.

Figure 5:
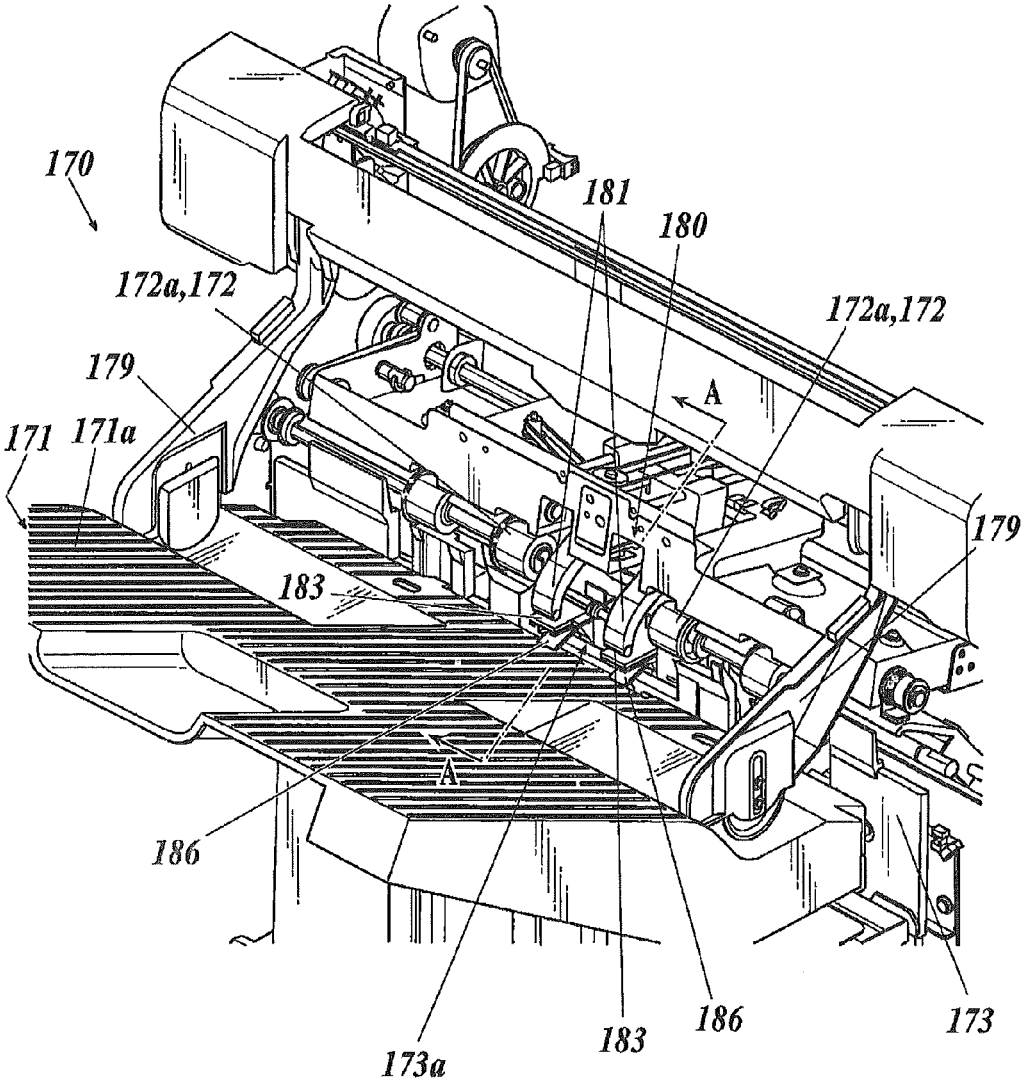
FIG. 5 is a perspective view illustrating an example of a final ejection section.

Further, above the elevating paper ejection tray 171, a pair of alignment members 179 for aligning the end portion positions of the sheets P and the sheet bundles S is provided in the sheet width direction which is at a right angle to the sheet ejection direction of the sheets P and the sheet bundles S ejected to the elevating paper ejection tray 171 (see FIG. 5).

The pair of alignment members 179 is set so as to face each other with a predetermined gap therebetween in the sheet width direction and is rotatable toward and away from the elevating paper ejection tray 171.

Each of the pairs of ejection rollers 172 and 172 is disposed with a predetermined gap therebetween along its shaft direction (FIG. 5).

The pairs of ejection rollers 172 and 172 nip the sheet P conveyed from the shift section 130 or the sheet bundle S conveyed from the accumulation section 140 in the front back direction to apply conveyance force and performs ejection.

Among the pairs of ejection rollers 172 and 172, the lower ejection rollers are driving rollers 172*b* and connected to a paper ejection driving motor (not shown in the drawings) which is speed adjustable.

On the other hand, among the pairs of ejection rollers 172 and 172, the upper paper ejection rollers are following rollers 172*a* which abut the driving rollers 172*b* and rotate in accordance with the driving rollers 172*b*.

When entering between the driving rollers 172*b* and the following rollers 172*a* to be nipped therebetween, the sheet P or the sheet bundle S is ejected by the driving rollers 172*b* applying the conveyance force.

Also, a sheet position detection sensor (not shown in the drawings) is disposed in the upstream side of the sheet ejection direction of the pairs of ejection rollers 172 and 172. After the sheet position detection sensor detects the reach of the sheet P or the sheet bundle S, the rotation speed of the pairs of ejection rollers 172 and 172 is reduced at the same timing.

By reducing the rotation speed of the pairs of ejection rollers 172 and 172, the sheet ejection operation of the final ejection section 170 can be more assured.

The abutting unit 173 is provided vertically near the base end portion of the stacking surface 171*a* of the elevating paper ejection tray 171, and includes a plate member which has a predetermined gap 173*a* (see FIG. 5). The abutting unit 173 may include two plate members with a predetermined gap 173*a* therebetween.

The abutting unit 173 is the base for aligning the rear ends of the sheets P or the sheet bundles S when the sheets P or the sheet bundles S are stacked on the stacking surface 171*a* of the elevating paper ejection tray 171 by the operation of the sheet nipping section 180.

The driving section 174 moves the elevating paper ejection tray 171 upward and downward along the abutting unit 173 according to the control of the control section C1.

Specifically, the driving section 174 includes a wire 175 wound around a driving pulley 175*a* and a following pulley 175*b*, and an elevating motor M which rotates the driving pulley 175*a* via a speed reducing gear train Z (see FIG. 3).

That is, when the elevating motor M rotates the driving pulley 175*a* via the speed reducing gear train Z according to the control of the control section C1, the wire 175 wound around the driving pulley 175*a* and the upper following pulley 175*b* rotates.

Then, one end portion of the wire 175 is fixed on the base portion of the elevating paper ejection tray 171 by a locking member 176, and the elevating paper ejection tray 171 is elevated or lowered along the abutting unit 173 by the rotation of the wire 175.

A roller 178 is supported at the base portion of the elevating paper ejection tray 171 so as to be rotatable and elevates and lowers the elevating paper ejection tray 171 smoothly.

The driving section 174, according to the control of the control section C1, starts moving the elevating paper ejection tray 171 to the predetermined height when the image forming processing is started.

Also, the driving section 174 lowers the elevating paper ejection tray 171 for a predetermined distance when the sheet P or the sheet bundle S is stacked on the elevating paper ejection tray 171.

Figure 6:
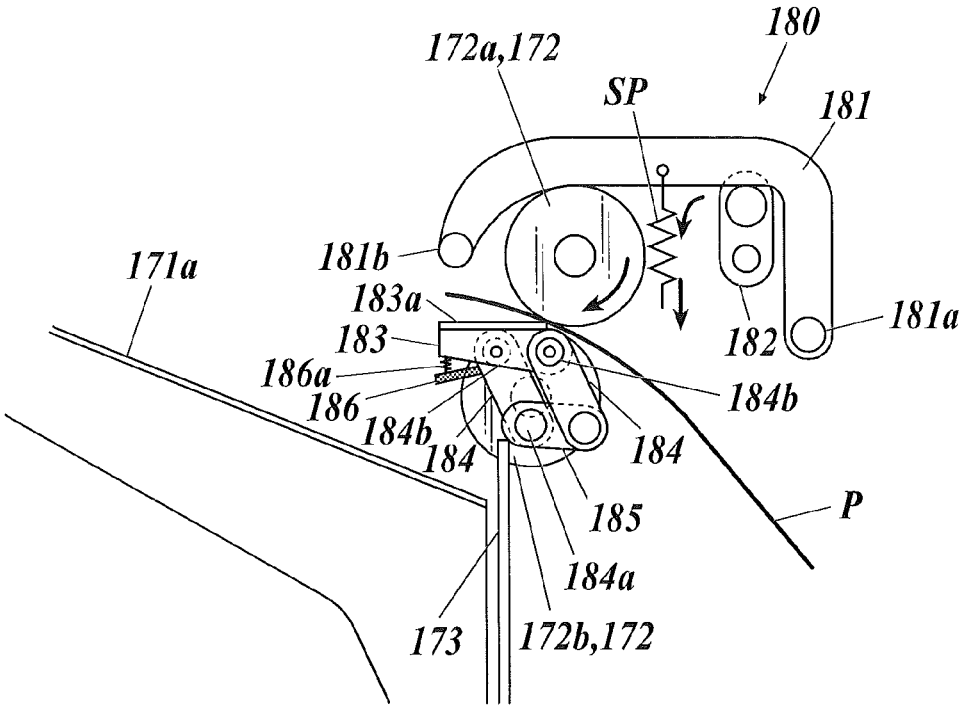
FIG. 6 is a schematic view illustrating an example of a sheet nipping section.

The sheet nipping section 180 is configured by including a pair of a rocking member 181 and a rotating member 183 (see FIGS. 5 and 6).

In the embodiment, two pairs of the rocking member 181 and the rotating member 183 are provided in the gap 173*a* of the abutting unit 173 (see FIG. 5).

The sheet nipping section 180, by the control of the control section C1, performs nipping operation when the operation mode is the first mode, and performs flattening operation when the operation mode is the second mode.

Here, the nipping operation is the operation of nipping the sheet P, which is ejected one by one by the pairs of ejection rollers 172 and 172, in the cooperation between the rocking members 181 and the rotating members 183, and moving the sheet P to the elevating paper ejection tray 171. That is, both of the rocking members 181 and the rotating members 183 are driven when performing the nipping operation of the first mode.

The flattening operation is the operation of rotating the rotating members 183 at a position abutting the rear portion of the surface of the sheet bundle S to solve the rear end remaining when the rear end remaining occurs. The rear end remaining is a phenomenon that the rear end of the sheet bundle S remains at the position abutting the abutting unit 173 due to the lowering of the elevating paper ejection tray 171 after the sheet bundle S is ejected by the pairs of ejection rollers 172 and 172 and stacked on the elevating paper ejection tray 171. Thus, only the rotating members 183 are driven when performing the flattening operation of the second mode.

The rocking members 181 are held so as to be rockable above the sheet P ejected by the pairs of ejection rollers 172 and 172.

Specifically, the rocking members 181 are formed to be arm-shaped, and include a fixed rotating shaft 181*a* at one ends which rockably holds the rocking members 181, and pressing sections 181*b* at the other ends, which press the rotating members 183 via the sheet. Further, spring members SP which apply pressing force for pressing the rotating members 183 to the pressing sections 181*b* are locked at the rocking members 181, and the spring members SP are biased in the direction rotating the rocking members 181 counterclockwise.

Pressing control members 182 which control the position of the rocking members 181 are provided adjacent to the rocking members 181.

The pressing control members 182 are connected to a driving motor (not shown in the drawings) which drives the pressing control members 182 and is reversibly rotatable, and when the driving motor drives according to the control of the control section C1, the pressing control members 182 rotate both forward and backward and thus the rocking members 181 rock.

As described above, the rocking members 181 operate (rock) only when the operation mode is the first mode.

Thus, when the operation mode is the first mode, the rocking members 181 standby at the standby position above which is away from the rotating members 183 until the sheet P approaches the predetermined position to be nipped, and the rocking members 181 rock at the predetermined timing to nip the rear end of the sheet P with the rotating members 183.

When the operation mode is the second mode, the rocking members 181 always stand by at the standby position.

The rotating members 183 are held below the sheet P or the sheet bundle S ejected by the pairs of ejection rollers 172 and 172 so as to rotate from the above of the base end portion of the elevating paper ejection tray 171 through the gap 173*a* in the abutting unit 173.

Specifically, each of the rotating members 183 is fixed on one ends of a pair of rotating plates 184 having the same size and the same shape, via a pair of shafts 184*b*.

A pair of rotating shafts 184*a* is fixed on the other ends of the pair of rotating plates 184, and the pair of rotating shafts 184*a* is held at a holding plate 185 so as to be rotatable.

The pair of rotating shafts 184*a* is connected to driving motors (not shown in the drawings) which rotate the rotating shafts 184*a* counterclockwise. The driving motors are configured so as to perform rotation operation at the same speed in the same direction and at the same time by the control of the control section C1. The pair of rotating plates 184 has different phases in the rotating shaft direction, and is disposed so as not to interfere with each other when rotating. The pair of rotating plates 184 rotates at the same speed in the same direction and at the same time to rotate the rotating member 183.

The pair of rotating plates 184 is controlled so as to rotate once for one nipping operation of the sheet P and to rotate once for one flattening operation of the sheet bundle S.

Each of the rotating members 183 includes a sheet nipping surface 183*a* which the pressing section 181*b* of the rocking member 181 abuts via the sheet P. It is preferable that the sheet nipping surface 183*a* is constantly horizontal or maintains at a constant angle toward the horizon regardless of the rotation angle of the pair of rotating plates 184.

The sheet nipping surface 183*a* is roughed so as to increase the friction coefficient. The friction coefficient of the sheet nipping surface 183*a* is set to be larger than the friction coefficient of the pressing section 181*b* of the rocking member 181 and larger than the friction coefficient between the sheets P.

By setting the friction coefficient of the sheet nipping surface 183*a* of the rotating member 183 to be larger than the friction coefficient of the pressing section 181*b* of the rocking member 181 and larger than the friction coefficient between the sheets P as described above, the position of the sheet P can be easily corrected when the uppermost sheet P stacked on the elevating paper ejection tray 171 is shifted toward the downstream side in the sheet conveyance direction.

The configuration to increase the friction coefficient is not limited to roughing.

A friction member 186 is provided on the lower surface (the surface opposite to the sheet nipping surface 183*a*) of each of the rotating members 183 via the spring member 186*a*.

The friction member 186 is a friction plate which is formed of a material such as rubber and foamed resin. The friction coefficient at the sheet abutting surface (lower surface) of the friction member 186 is set to be larger than the friction coefficient between the sheets P (sheet bundles S) stacked on the elevating paper ejection tray 171.

The sheet abutting surface of the friction member 186 is variable in position by the spring member 186*a*. Since the abutting surface between the friction member 186 and the sheet P (sheet bundle S) is variable in position, the frictional resistance to the sheet P (sheet bundle S) can be nearly constant even when the thickness of the sheet bundles stacked on the elevating paper ejection tray 171 changes.

As described above, the rotating members 183 operate (rotate) at a timing according to the mode when the operation mode is the first mode or the second mode.

Thus, when the operation mode is the first mode, the rotating members 183 rotate at the timing of ejecting the sheet P by the pairs of ejection rollers 172 and 172, and nip the rear end of the sheet P with the rocking members 181.

On the other hand, when the operation mode is the second mode, the rotating members 183 rotate after the sheet bundle S is stacked on the elevating paper ejection tray 171 and the elevating paper ejection tray 171 is lowered to the predetermined position, and perform flattening operation to the rear end remaining of the sheet bundle S.

The paper feeding section 190 is disposed in the upper level of the sheet processing apparatus C and includes a first paper feeding tray 191, a second paper feeding tray 192 and a fixed paper ejection tray 193.

Sheets of paper as a cover sheet or such like are placed on the first paper feeding tray 191 and the second paper feeding tray 192. When the booklet processing for attaching a cover to the sheet bundle S is selected, the sheet drawn from the first paper feeding tray 191 or the second paper feeding tray 192 is conveyed to the accumulation section 140 and attached as the cover to the sheet bundle S accumulated in the accumulation section 140.

The sheets P for which no post-processing is selected are ejected to the fixed paper ejection tray 193, for example. That is, when no post-processing is selected, the sheet P is conveyed from the branch point Q toward the fixed paper ejection tray 193 and accumulated on the fixed paper ejection tray 193.

The detection sensor PS is a transmissive or reflective optical sensor, for example.

The detection sensor PS is provided at a position above the stacking surface 171*a* of the elevating paper ejection tray 171 and below the sheet nipping section 180 (rotating members 183), and detects that the sheet bundle S stacked on the elevating paper ejection tray 171 exists at a predetermined position.

Specifically, the detection sensor PS outputs a detection signal of detecting the existence of the sheet bundle S to the control section C1 when the sheet bundle S is stacked on the stacking surface 171*a* of the elevating paper ejection tray 171.

Thereafter, when the elevating paper ejection tray 171 is lowered and stopped and the sheet bundle S is not detected, the detection sensor PS stops the output of the detection signal. When the sheet bundle S continues to be detected even after the elevating paper ejection tray 171 is lowered and stopped, the detection sensor PS continues outputting the detection signal, and thus the control section C1 can recognize the generation of the rear end remaining.

The control section C1 controls operations of the sections in the sheet processing apparatus C.

The control section C1 includes, for example, a CPU (Central Processing Unit) 101, a RAM (Random Access Memory) 102, a ROM (Read Only Memory) 103 and a storage section 104. The CPU 101 reads and processes software, various data and such like stored in the storing devices such as the ROM 103 or the storage section 104, and performs various types of processing according to operations of the sheet processing apparatus C.

For example, the control section C1 sets the operation mode to either the first mode or the second mode according to the setting made at the start of the image forming processing.

Then, when the operation mode is the first mode, the control section C1 drives the rocking members 181 and the rotating members 183 of the sheet nipping section 180 to perform the nipping operation.

Specifically, when the sheet P is ejected by the pairs of ejection rollers 172 and 172, the control section C1 drives the rocking members 181 and the rotating members 183 at the same timing by the detection of the sheet position detection sensor, to nip the rear end portion of the sheet P and move the rear end portion to the stacking surface 171*a* of the elevating paper ejection tray 171 so as to abut the abutting unit 173.

When the operation mode is the second mode, the control section C1 drives only the rotating members 183 of the sheet nipping section 180 to perform the flattening operation.

Specifically, when the sheet bundle S is ejected from the pairs of ejection rollers 172 and 172 and stacked on the elevating paper ejection tray 171, the control section C1 controls the driving section 174 to lower the elevating paper ejection tray 171. At that time, the control section C1 lowers the elevating paper ejection tray 171 only for a distance which is previously set according to the thickness of the sheet bundle S.

After the lowering of the elevating paper ejection tray 171 is stopped, the control section C1 performs detection of the rear end remaining of the sheet bundle S by the detection sensor PS, and makes the rotating members 183 start rotating if the rear end remaining is detected by the detection sensor PS.

In addition, the control section C1 controls operations of the sections such as the sheet conveyance section 110, the punching section 120, the shift section 130, the accumulation section 140, the stapling section 150, the folding section 160 and the paper feeding section 190 so as to carry out various processing according to the setting.

Next, a series of sheet ejection operations according to the ejection of the sheets P or the sheet bundles S in the sheet processing apparatus C will be described. The following operations are performed by the control of the control section C1.

First, the first mode or the second mode is set according to the setting which is set when the image forming processing is performed by the image forming apparatus B.

That is, the first mode is set when the sheet P on which an image is formed by the image forming apparatus B is to be ejected one by one on the elevating paper ejection tray 171 via the sheet processing apparatus C.

The second mode is set when the sheets P on which images are formed by the image forming apparatus B are to be stapled by the stapling section 150 of the sheet processing apparatus C and the sheet bundle S is to be ejected on the elevating paper ejection tray 171, for example.

Figure 7A:
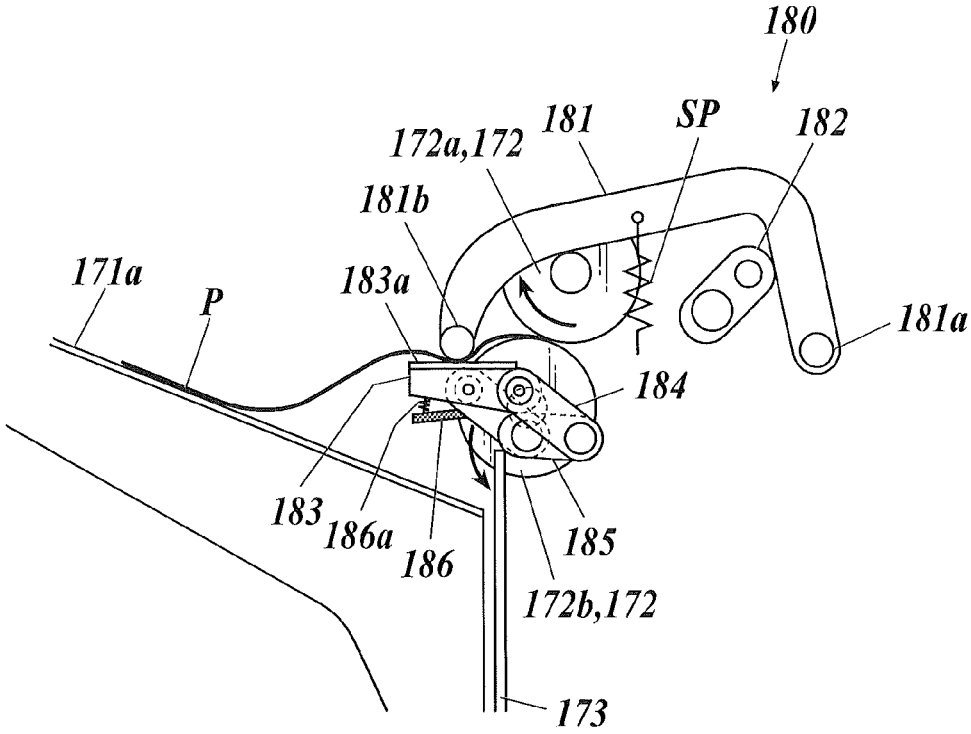
FIG. 7A is a diagram for explaining a nipping operation to a sheet of the sheet nipping section.
Figure 7B:
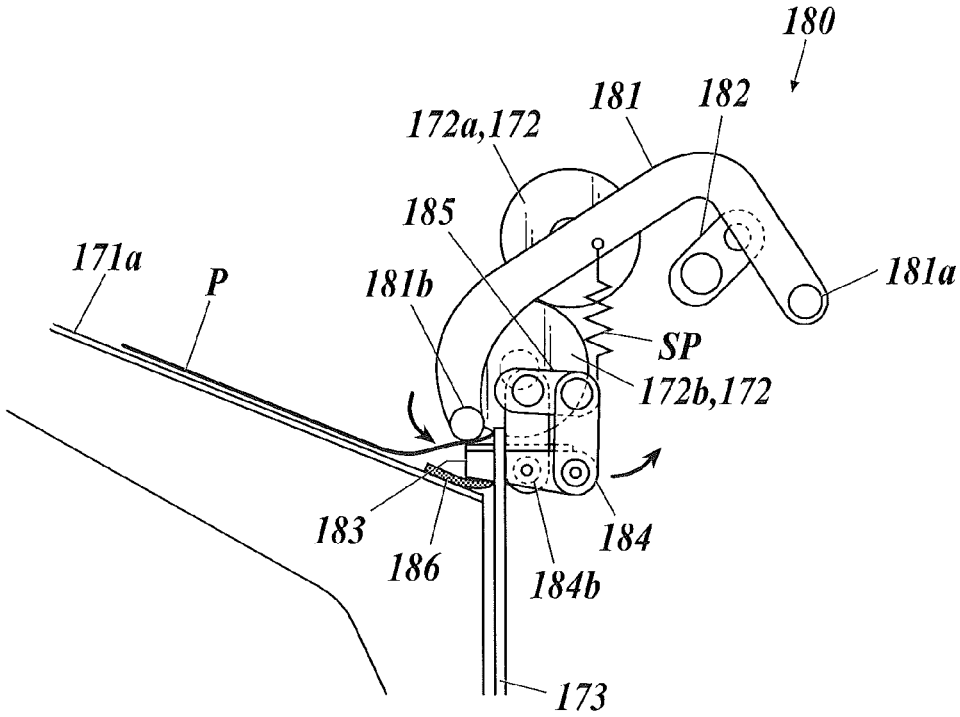
FIG. 7B is a diagram for explaining the nip operation to a sheet of the sheet nipping section.

In the first mode, when the sheet P is ejected from the pairs of ejection rollers 172 and 172, the control section C1 operates the rocking members 181 and the rotating members 183 at the predetermined timing to nip the rear end portion of the sheet P (see FIG. 7A) and stack the sheet P on the stacking surface 171*a* of the elevating paper ejection tray 171 (see FIG. 7B).

Thus, the sheet P sent from the pairs of ejection rollers 172 and 172 is stacked on the elevating paper ejection tray 171 with the rear end abutting the abutting unit 173.

When the sheet P is stacked on the elevating paper ejection tray 171, the control section C1 lowers the elevating paper ejection tray 171 by the driving section 174 according to the weight of the sheets P stacked on the elevating paper ejection tray 171.

By performing the above operation for each sheet P, the sheet P can be stacked on the elevating paper ejection tray 171 stably.

On the other hand, in the second mode, the sheet bundle S ejected from the pairs of ejection rollers 172 and 172 falls onto the stacking surface 171*a* of the elevating paper ejection tray 171 by its own weight and slides the stacking surface 171*a* downward to be stacked on the elevating paper ejection tray 171 with the rear end abutting the abutting unit 173.

When the sheet bundle S is stacked on the elevating paper ejection tray 171, the control section C1 lowers, by the driving section 174, the elevating paper ejection tray 171 for a fall distance which is previously set according to the thickness of the sheet bundle S.

Next, the control section C1 performs detection of the rear end remaining of the sheet bundle S by the detection sensor PS.

Figure 8A:
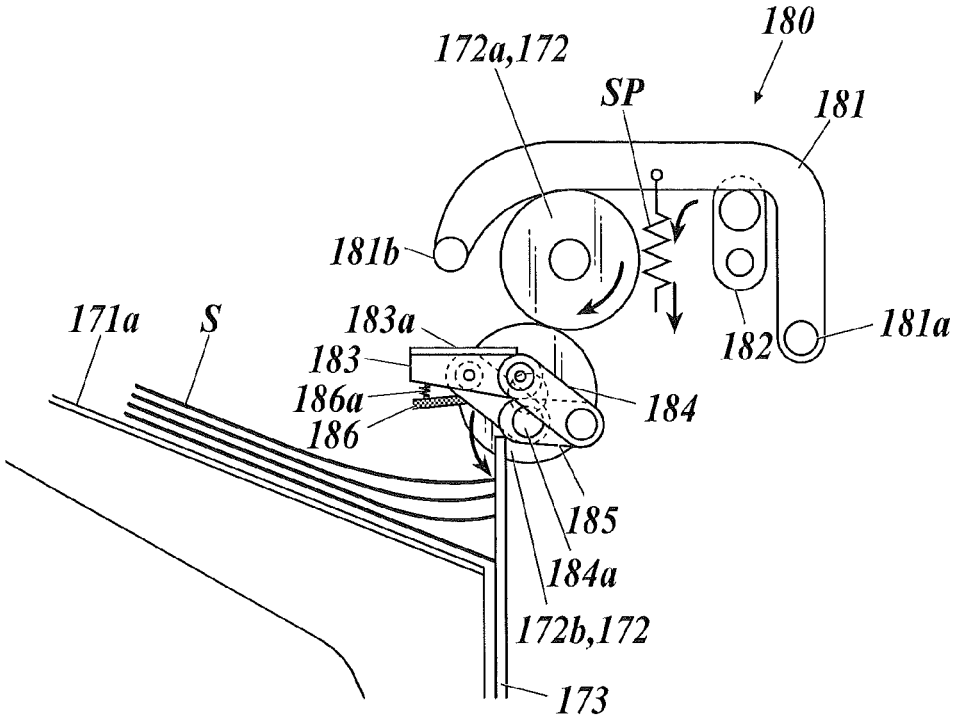
FIG. 8A is a diagram for explaining a flattening operation to a sheet bundle of the sheet nipping section.

If the rear end remaining is detected by the detection sensor PS, the control section C1 makes the rotating members 183 start rotating (see FIG. 8A).

Upon starting the rotation, the rotating members 183 operate to pass through the gap 173*a* in the abutting unit 173 while abutting the rear portion of the surface of the sheet bundle S stacked on the elevating paper ejection tray 171.

Figure 8B:
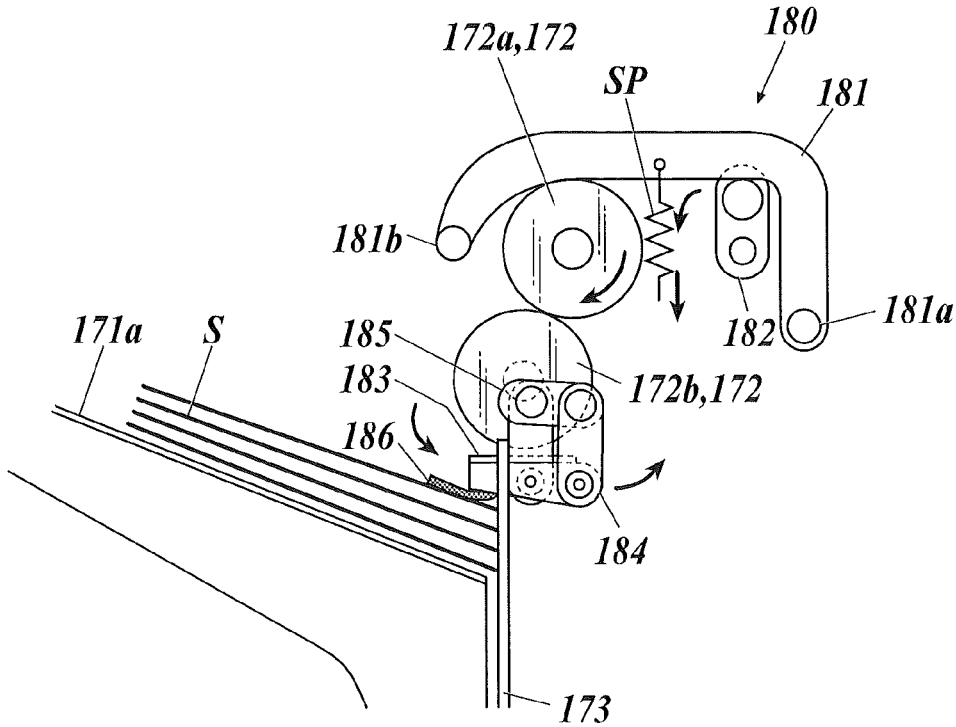
FIG. 8B is a diagram for explaining the flattening operation to a sheet bundle of the sheet nipping section.

Specifically, the rotating members 183 operate so that the sheet abutting surfaces (lower surfaces) of the friction members 186 of the rotating members 183 abut the rear end remaining portion at the rear portion of the surface of the sheet bundle S and the sheet abutting surfaces of the friction members 186 push the rear end remaining portion at the rear of the surface of the sheet bundle S against the elevating paper ejection tray 171 (see FIG. 8B).

Figure 9:
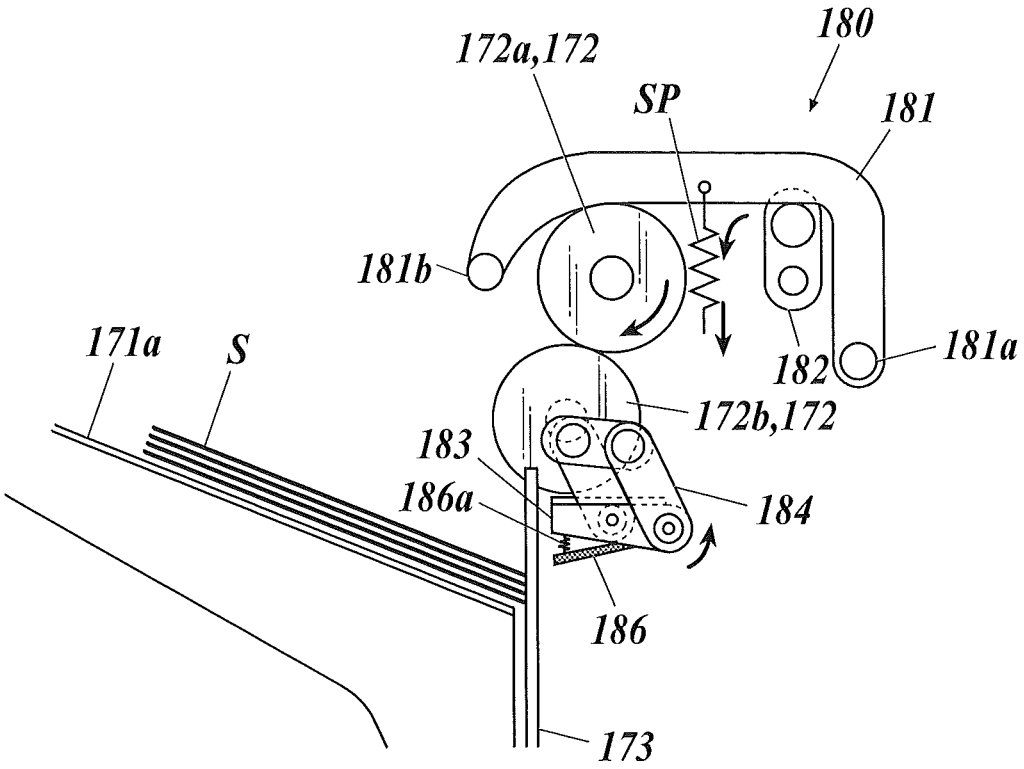
FIG. 9 is a diagram for explaining the flattening operation to a sheet bundle of the sheet nipping section.
Figure 10A:
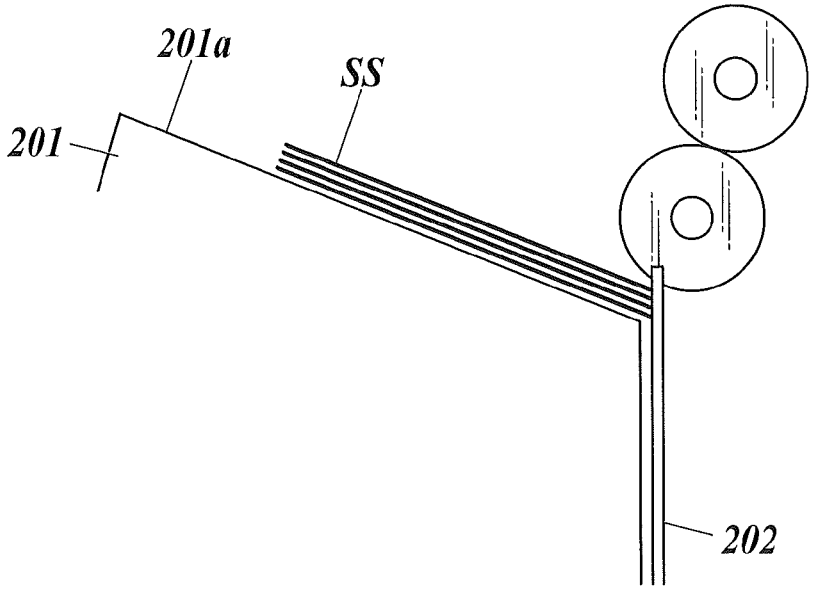
FIG. 10A is a diagram for explaining conventional problems.
Figure 10B:
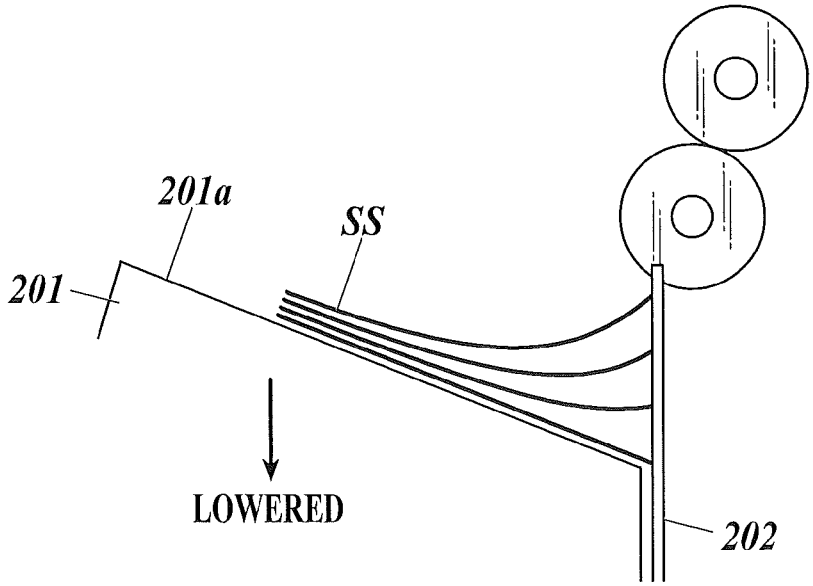
FIG. 10B is a diagram for explaining conventional problems.

Thereafter, by the rotating members 183 rotating further, the sheet abutting surfaces of the friction members 186 come off the surface of the sheet bundle S, and the rear end remaining portion of the sheet bundle S on the elevating paper ejection tray 171 is flattened (see FIG. 9).

If the rear end remaining of the sheet bundle is not detected by the detection sensor PS, the control section C1 shifts to the ejection operation of the following sheet bundle S without rotating the rotating members 183.

By performing the above operation for each sheet bundle S, the sheet bundle S can be stacked on the elevating paper ejection tray 171 stably.

As described above, according to the embodiment, a sheet processing apparatus C includes a pair of ejection rollers 172 which ejects a bundle of sheets S on which predetermined processing is performed; an elevating paper ejection tray 171 on which the sheet bundle S ejected by the pair of ejection rollers 172 is stacked; an abutting unit 173 which stands near a base end portion of the elevating paper ejection tray 171 and abuts a rear end of the sheet bundle S; a driving section 174 which moves the elevating paper ejection tray 171 upward and downward; a control section C1 which lowers the elevating paper ejection tray 171 by controlling the driving section 174 when the sheet bundle S is stacked on the elevating paper ejection tray 171; and a rotating member 183 which has a rotating shaft in parallel with a width direction of the sheet bundle S and is held so as to rotate from above the base end portion of the elevating paper ejection tray 171 through a gap 173*a* of a predetermined width in the abutting unit 173; the control section C1 starts rotation of the rotating member 183 after lowering of the elevating paper ejection tray 171 is stopped, and when the rotation is started, the rotating member 183 operates so as to abut a rear portion of a surface of the sheet bundle S stacked on the elevating paper ejection tray 171 and pass through the gap 173*a* in the abutting unit 183.

Thus, the surface of the sheet bundle S is flattened by the rotating members 183.

Therefore, when the rear end remaining occurs upon the lowering of the elevating paper ejection tray 171 on which the sheet bundles S are stacked, the rear end remaining can be solved, the appearance can be improved because the sheet bundle S is not swelled, and the following sheet bundles S can be stacked stably.

Also, according to the embodiment, the sheet bundle S is a sheet bundle which is stapled.

Thus, the stapled sheet bundle S of a booklet can be stacked on the elevating paper ejection tray 171 stably.

Further, according to the embodiment, the sheet processing apparatus C further includes a rocking member 181 above the rotating member 183, the rocking member 181 rocking in synchronization with the rotation of the rotating member 183, and the rotating member 183 and the rocking member 181 are a sheet nipping section 180 which nips a rear end portion of the sheet P and moves the rear end portion to an upper surface (stacking surface 171*a*) of the elevating paper ejection tray 171 when the sheet P is to be ejected one by one by the pair of ejection rollers 172.

Thus, to perform the nipping operation and the flattening operation, it is only necessary to switch the operations of the sheet nipping section 180 and no additional member is needed, avoiding a complicated configuration of the apparatus.

Further, according to the embodiment, the sheet processing apparatus C further includes a detection sensor PS above the elevating paper ejection tray 171, the detection sensor PS detecting whether the sheet bundle S stacked on the elevating paper ejection tray 171 exists at a predetermined position, the control section C1 starts the rotation of the rotating member 183 when the detection sensor PS detects existence of the sheet bundle S after the lowering of the elevating paper ejection tray 171 is stopped.

Therefore, the rotating members 183 operate only when the rear end remaining occurs, avoiding unnecessary operation of the rotating members 183.

The present invention is not limited to the above embodiment and various changes can be made appropriately.

For example, the embodiment describes, as an example, the configuration that the control section C1 starts rotating the rotating members 183 in a case where the detection sensor PS detects the existence of the sheet bundle S after the lowering of the elevating paper ejection tray 171 is stopped. However, the control section C1 may start rotating the rotating members 183 after stopping the lowering of the elevating paper ejection tray 171 in a case where the number of sheet bundles S is equal to or more than a predetermined number.

Such configuration assumes that the rear end remaining will not occur when the number of sheet bundles S is small, and can save the operation to the sheet bundles S which can not have the rear end remaining.

Specifically, for example, there may be a setting that the rotating members 183 are rotated when the number of the sheet bundles S is equal to or more than 11, and the rotating members 183 are not rotated when the number of sheet bundles S is less than 11.

Such predetermined number of sheet bundles can be appropriately set according to the sheet information including the number, size and type of the sheets forming the sheet bundle S.

Thus, appropriate setting is made for each ejected sheet, and the sheet bundles S can be stacked on the elevating paper ejection tray 171 more stably.

Alternatively, the control section C1 may start rotating the rotating members 183 when the number of sheet bundles S is equal to or more than the predetermined number and the detection sensor PS detects the existence of the sheet bundle S after the lowering of the elevating paper ejection tray 171 is stopped.

This configuration saves the operation to the sheet bundles S which can not have the rear end remaining, and the rotating members 183 are operated for the sheet bundles S which can have the rear end remaining only when the sheet bundle S actually has the rear end remaining, and thus the rotating members 183 can be operated more effectively.

Though the embodiment describes, as an example, the configuration that only the rotating members 183 are operated and the rocking members 181 are not operated in the second mode, both of the rocking members 181 and the rotating members 183 may be operated even in the second mode.

The entire disclosure of Japanese Patent Application No. 2012-134518 filed on Jun. 14, 2012 including description, claims, drawings, and abstract are incorporated herein by reference in its entirety.

What is claimed is:

1. A sheet processing apparatus, comprising:

an ejection section which ejects a bundle of sheets on which predetermined processing is performed;

a sheet stacking section on which the sheet bundle ejected by the ejection section is stacked;

an abutting unit which is provided near a base end portion of the sheet stacking section and abuts a rear end of the sheet bundle;

a driving section which moves the sheet stacking section upward and downward;

a control section which lowers the sheet stacking section by controlling the driving section when the sheet bundle is stacked on the sheet stacking section; and a rotating member which has a rotating shaft in parallel with a width direction of the sheet bundle and is held so as to rotate from above the base end portion of the sheet stacking section through a gap of a predetermined width in the abutting unit;

wherein the control section starts rotation of the rotating member after lowering of the sheet stacking section is stopped, and when the rotation is started, the rotating member operates so as to abut a rear portion of a surface of the sheet bundle stacked on the sheet stacking section and pass through the gap in the abutting unit.

2. The sheet processing apparatus of claim 1, wherein the predetermined processing is stapling.

3. The sheet processing apparatus of claim 1, further comprising a rocking member above the rotating member, the rocking member rocking in synchronization with the rotation of the rotating member, wherein the rotating member and the rocking member are a sheet nipping section which nips a rear end portion of the sheet and moves the rear end portion to an upper surface of the sheet stacking section when the sheet is to be ejected one by one by the ejection section.

4. The sheet processing apparatus of claim 1, further comprising a detection section above the sheet stacking section, the detection section detecting whether the sheet bundle stacked on the sheet stacking section exists at a predetermined position, wherein the control section starts the rotation of the rotating member when the detection section detects existence of the sheet bundle after the lowering of the sheet stacking section is stopped.

5. The sheet processing apparatus of claim 1, wherein the control section starts the rotation of the rotating member after the lowering of the sheet stacking section is stopped when the number of the sheet bundles is equal to or more than a predetermined number which is previously set.

6. An image forming system, comprising:

an image forming apparatus which forms an image on a sheet of paper; and a sheet processing apparatus of claim 1 which is connected to the image forming apparatus and performs predetermined processing on the sheet on which the image is formed by the image forming apparatus.

* * * * *